United States Patent [19]

Fray et al.

[11] 4,412,893

[45] Nov. 1, 1983

[54] ANODE-ASSISTED CATION REDUCTION

[75] Inventors: Derek J. Fray, Trumpington; John P. Chilton; Arthur V. Cooke, both of Cambridge, all of England

[73] Assignee: National Research Development Corporation, London, England

[21] Appl. No.: 464,867

[22] Filed: Feb. 8, 1983

Related U.S. Application Data

[63] Continuation-in-part of Ser. No. 244,772, Mar. 17, 1981.

[30] Foreign Application Priority Data

Mar. 17, 1980 [GB] United Kingdom ..... 8008953

[51] Int. Cl.[3] ..... C23F 1/04; C23C 1/06; C23C 1/10; C23C 1/08

[52] U.S. Cl. ..... 204/105 R; 204/105 M; 204/106; 204/108; 204/109; 204/112; 204/114; 204/129

[58] Field of Search ..... 204/106, 108, 109, 112, 204/129, 105 M, 114, 105 R

[56] References Cited

U.S. PATENT DOCUMENTS 3,761,369 9/1973 Tirrell ..... 204/108

*Primary Examiner*—R. L. Andrews

*Attorney, Agent, or Firm*—Cushman, Darby & Cushman

[57] ABSTRACT

A method of cation reduction by anode-assisted electrolysis comprises electrolyzing cations at a cathode of a cell in which the anolyte contains ferrous ion as a reducing agent, with relative motion between the anode and the anolyte such as to promote contact of the anode with ferrous ion despite their mutual electrostatic repulsion, wherein the concentration of the ferrous ion is from 0.5 to 10 g/l. The relative motion between the anode and the anolyte can take the form of air-sparging. The method can be used to produce copper metal from copper solution. While static relationship is maintained between the cathode and the catholyte, the anolyte being in free communication with the catholyte.

11 Claims, No Drawings

ANODE-ASSISTED CATION REDUCTION

CROSS-REFERENCE TO RELATED APPLICATIONS

This is a continuation-in-part of our earlier application Ser. No. 244,772 filed Mar. 17, 1981.

BACKGROUND OF THE INVENTION

This invention relates to a method of cation (e.g., metal) reduction by anode-assisted electrolysis.

The total potential E(total) in volts of a practical electrowinning cell may be given by:

$$E(\text{total}) = E_A - E_c + E(op) + iR$$

where $E_A$ is the potential of the anodic reaction $H_2O \rightarrow \frac{1}{2}O_2 + 2H^+ + 2e$, $E_c$ is the potential for reducing the metal ion or hydrogen ion (at the cathode), E(op) includes the associated overpotentials, and iR is the potential drop within the circuit of resistance R (ohms) carrying a current i (amps). When the oxygen pressure is at one atmosphere and $a_{H^+} = 1$, i.e., pH=O, $E_A$ becomes $E^\circ_A$ of value 1.23 V at 25° C.

Metal reduction by anode-assisted electrolysis has been described by Farooque and Coughlin (Nature, August 23, 1979), who propose that carbon should be provided as a reducing agent at the anode, so that the anodic reaction becomes (they say)

$$C + 2H_2O \rightarrow CO_2 + 4H^+ + 4e$$

for which $E^\circ_A$ is only about 0.21 V. This substantially lessens E(total). Farooque and Coughlin propose to provide the carbon in the form of a coal or lignite slurry agitated against a platinum mesh anode, for their anode-assisted metal reduction. However using this method we find that frequent rest periods are necessary to keep the anode at peak effectiveness, unless the anode current density is kept down to about 20 $Am^{-2}$, which is far too low for industrial acceptability.

Report No. 1754 (June 1975) of the National Institute for Metallurgy, South Africa, suggests that ferrous ion in a concentration of 50 to 55 g/l could be used as a reducing agent at the anode, with techniques to enhance mass transfer to the anode surface, the anode consisting of a packed bed of, for example, graphite grains to minimize the current density per unit area of the anode.

This ferrous ion concentration is so high as to interfere with the electrowinning reduction at the cathode unless a diaphragm is provided between anode and cathode. A diaphragm is one of the more troublesome components of a cell.

DETAILED DESCRIPTION OF THE INVENTION

According to the present invention a method of cation reduction by anode-assisted electrolysis comprises electrolyzing cations in the cathode compartment of a cell in which the anode compartment contains ferrous ion as a reducing agent, the electrolysis being conducted while the anolyte is agitated or the anode is moved with respect to the anolyte thereby providing relative motion between the anode and the anolyte such as to promote contact of the anode with ferrous ion despite their mutual electrostatic repulsion, characterized in that the concentration of the ferrous ion is from ½ to 10 g/l. During the electrolysis a static relationship is maintained between the cathode and the catholyte. Preferably the method is further characterized in that the anolyte is in free communication with the catholyte, i.e., characterized by diaphragmless operation, except as indicated below.

The anode compartment may be agitated, for example by air sparging or by paddle member, or the anode may be moved with respect to the anolyte, e.g., reciprocated, oscillated, or rotated, or the electrolyte may be pumped. There is negligible movement between the cathode and the catholyte.

Preferably the anode is of platinum or graphite or is a dimensionally stable anode such as platinized titanium (which may include platinum oxide) or titanium coated with iridium oxide or iridium oxide on a platinum support, but is preferably not of lead, lead/antimony, aluminum or ruthenium-oxide-coated dimensionally stable anode, which either do not catalyze the Fe(II)/Fe(III) oxidation or present other difficulties.

Ferrous ion which has been used as a reducing agent in the method can be regenerated from the resultant ferric back to the ferrous state by any suitable method, for example employing the reaction:

$$2Fe_2(SO_4)_3 + Cu_2S \rightarrow 2CuSo_4 + 4FeSO_4 + S$$

or $$Fe_2(SO_4)_3 + SO_2 + 2H_2O \rightarrow 2FeSo_4 + 2H_2SO_4$$

and can then be recycled. Another way of regenerating the ferrous ion is to contact the ferric ion with a suspension of lignite, held at a temperature preferably greater than 40° C., preferably in a vessel external to the cell.

The anolyte may be at room temperature (say 20° C.) or above or below. A preferred temperature range is 50°-100° C.

The cation to be reduced may be a metal ion which is to be reduced to the element at the cathode, being in that case either (i) any metal more noble than iron including copper, silver, nickel, cobalt or hydrogen, or (ii) a metal less noble than iron. For each member of class (i), which is the preferred class of metal ions, the standard electrode potential of the metal being more noble than that of $Fe^{2+}/Fe$ (−0.44 V), the method may be used as set forth above. For members of class (ii), such as Zn, Mn and Cr, the method may be used but an ion-selective diaphragm must be provided between the anode and the cathode to prevent the deposition of iron instead of the desired metal.

The concentration of ferrous ion in the anolyte is preferably at least 1 g/l, more preferably at least 1½ g/l, most preferably at least 2 g/l, and preferably does not exceed 6 g/l, and more preferably does not exceed 5 g/l.

The invention will now be described by way of the following examples.

EXAMPLE 1

A diaphragm cell was set up having a cathode compartment comprising a copper cathode of area 6 $cm^2$ and a catholyte of acidified copper sulphate (containing 50 g/l copper plus 150 g/l sulphuric acid), and a semi-permeable diaphragm separating the cathode compartment from an anode compartment containing a platinum foil anode of area 6 $cm^2$. The anolyte was of the same copper and acid concentration as the catholyte but contained 2 g/l of ferrous ion. While reciprocating the anode in the anolyte to promote contact of the anode with ferrous ion, the cell was driven under a voltage of 0.9 volts to deposit copper on the cathode, and passed current at a rate of 170 $A/m^2$ for a duration of at least two hours at 70° C. The cathode and catholyte remained in a static relationship.

Without the presence of $Fe^{2+}$ in solution, the potential of the cell was 2.1 V. The reduction in voltage is greater than the difference in electrode potentials (due to the decreased polarization of the ferrous ion oxidation compared with the evolution of oxygen).

The ferrous ion in the anolyte is oxidized to ferric ion as the copper is deposited on the cathode, and the spent anolyte, containing ferric ion, was used to leach a cuprous sulphide ore. This both leached the ore to give dissolved cupric ion and reduced the ferric ion to ferrous, enabling the latter to replenish the anolyte. The raw material in the catholyte included the cupric ion liberated by the leaching.

EXAMPLE 2

A diaphragmless cell was set up having a cathode compartment comprising a titanium cathode of area 200 $cm^2$ and an electrolyte containing 50 g/l copper (as copper sulphate), 150 g/l sulphuric acid and 5 g/l ferrous ion (as ferrous sulphate). Spaced by 20 cm from the cathode was an anode of platinum/iridium oxide on titanium, of area 200 $cm^2$. The cathode remains static and the 20 cm spacing from the anode serves to maintain a static relationship between the cathode and the catholyte.

The cell was driven under a voltage of 1.75 V to deposit copper on the cathode, and passed current at a rate of 180 $A/m^2$ for at least two hours at 70° C. Without the presence of $Fe^{2+}$ in solution, the potential of the cell was 2.6 V, and the potential also rose above 1.75 V if the anode and anolyte were not kept in relative motion. This relative motion could be generated in several ways, for example by reciprocating (20 cycles/minute) a paddle member 1 mm × 1 cm × 20 cm in a plane spaced 1 cm from the anode, windscreen-wiper fashion.

Another way of generating this relative motion is by air-sparging. (Inert gas need not be used; air is quite satisfactory.) With the anode (200 $cm^2$) upright, three air jets of internal diameter 3 mm debouching 6 mm from the anode with a total of 250 $cm^3$ air per minute give satisfactory results. With the anode tilted 17° forwards from the vertical, the identical air jet arrangement gives equivalent results with a throughput of only 150 $cm^3$ air per minute.

Experiments using graphite as the anode suggest that the presence of ferrous ion still has a diminishing effect on cell voltage above current densities of about 180 $A/m^2$.

What is claimed is:

1. A method of reduction of cations more noble than iron by anode-assisted electrolysis comprising electrolyzing cations at a cathode of a cell in which the anolyte contains ferrous ion as a reducing agent, the electrolysis conducted while the anolyte is agitated or the anode is moved with respect to the anolyte thereby providing relative motion between the anode and the anolyte such as to promote contact of the anode with ferrous ion despite their mutual electrostatic repulsion, while at the same time maintaining a static relationship between the cathode and the catholyte, and the anolyte is in free communication with the catholyte wherein the concentration of the ferrous ion is from 0.5 to 10 g/l and the anode is of platinum, graphite, platinized titanium, platinized titanium including therein platinum oxide, titanium coated with iridium oxide, or iridium oxide on a platinum support.

2. The method according to claim 1, wherein the anolyte is agitated.

3. The method according to claim 2, wherein the anolyte is agitated by air-sparging or by a paddle member.

4. The method according to claim 1, wherein the anode is reciprocated, oscillated or rotated.

5. The method according to claim 1, wherein the anolyte is at a temperature of 20°–100° C.

6. The method according to claim 1, wherein the concentration of the ferrous ion is at least 1 g/l.

7. The method according to claim 1, wherein the concentration of the ferrous ion does not exceed 6 g/l.

8. The method according to claim 1, wherein the cation is reduced to the element at the cathode.

9. The method according to claim 8, wherein the cation is of copper, silver, nickel, cobalt or hydrogen.

10. The method according to claim 8, wherein the cation is of a metal less noble than iron, and wherein an ion-selective diaphragm separates the anode compartment from the cathode compartment.

11. A method according to claim 10, wherein the metal is zinc, manganese or chromium.

* * * * *